US011005207B2

(12) United States Patent
Mastel et al.

(10) Patent No.: US 11,005,207 B2
(45) Date of Patent: May 11, 2021

(54) PLUG-AND-SOCKET CONNECTOR FOR AN ELECTRICAL PLUG-AND-SOCKET CONNECTION, AND ELECTRICAL PLUG-AND-SOCKET CONNECTION CREATED THEREWITH

(71) Applicant: WAGO Verwaltungsgesellschaft mbH, Minden (DE)

(72) Inventors: Rudolf Mastel, Minden (DE); Marcel Pahl, Schloss Holte-Stukenbrock (DE); Henning Meier, Bueckeburg (DE); Philipp Ober-Woerder, Kirchlengern (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/862,545

(22) Filed: Apr. 29, 2020

(65) Prior Publication Data

US 2020/0350722 A1 Nov. 5, 2020

(30) Foreign Application Priority Data

Apr. 30, 2019 (DE) ..... 10 2019 111 166

(51) Int. Cl.
*H01R 13/422* (2006.01)
*H01R 13/502* (2006.01)
*H01R 13/514* (2006.01)

(52) U.S. Cl.
CPC ..... *H01R 13/422* (2013.01); *H01R 13/502* (2013.01); *H01R 13/514* (2013.01)

(58) Field of Classification Search
CPC .. H01R 13/442; H01R 13/502; H01R 13/514; H01R 13/627
See application file for complete search history.

(56) References Cited

U.S. PATENT DOCUMENTS 6,383,032 B1 * 5/2002 Gerberding ..... H01R 13/645 439/681
7,997,941 B2 * 8/2011 Pfaffenbach ..... H01R 13/645 439/680

(Continued)

FOREIGN PATENT DOCUMENTS

DE 84 10 181 U1 8/1984
DE 33 31 792 A1 3/1985

(Continued)

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A plug-and-socket connector for an electrical plug-and-socket connection that has the plug-and-socket connector and a mating connector associated with the plug-and-socket connector as a mating part to which the plug-and-socket connector can be attached in a plug-in direction, wherein the plug-and-socket connector has a housing and multiple electrical plug-in contacts that are arranged at least partially in the housing and that are arranged side by side in a row direction, wherein a first housing wall of the housing, which is arranged parallel to a plane spanned by the plug-in direction and the row direction, adjoins a second housing wall of the housing, which faces in the plug-in direction and is arranged at an angle to the first housing wall.

19 Claims, 7 Drawing Sheets

(56) References Cited

U.S. PATENT DOCUMENTS

| | | | | |
|---|---|---|---|---|
| 8,616,910 | B2 * | 12/2013 | Giefers | H01R 13/6275 439/358 |
| 9,537,259 | B2 * | 1/2017 | Mastel | H01R 13/639 |
| 10,218,112 | B2 * | 2/2019 | Luttermann | H01R 13/506 |
| 10,283,880 | B2 | 5/2019 | Kettern | |
| 2012/0238123 | A1 * | 9/2012 | Boemmel | H01R 13/516 439/345 |
| 2015/0357756 | A1 * | 12/2015 | Mastel | H01R 13/639 439/345 |
| 2020/0350722 | A1 * | 11/2020 | Mastel | H01R 13/502 |

FOREIGN PATENT DOCUMENTS

| | | | |
|---|---|---|---|
| DE | 44 20 984 | C2 | 9/1998 |
| DE | 20 2008 008 655 | U1 | 10/2009 |
| DE | 10 2009 018 715 | A1 | 11/2010 |
| DE | 10 2010 017 262 | A1 | 12/2011 |
| DE | 10 2010 036 038 | A1 | 3/2012 |
| DE | 20 2015 103 923 | U1 | 11/2015 |
| DE | 10 2015 115 612 | A1 | 3/2017 |
| EP | 0 104 755 | B1 | 5/1996 |
| WO | 10 2014 107 948 | B3 | 7/2015 |

* cited by examiner

PLUG-AND-SOCKET CONNECTOR FOR AN ELECTRICAL PLUG-AND-SOCKET CONNECTION, AND ELECTRICAL PLUG-AND-SOCKET CONNECTION CREATED THEREWITH

This nonprovisional application claims priority under 35 U.S.C. § 119(a) to German Patent Application No. 10 2019 111 166.8, which was filed in Germany on Apr. 30, 2019, and which is herein incorporated by reference.

BACKGROUND OF THE INVENTION

Field of the Invention

The present invention relates to a plug-and-socket connector for an electrical plug-and-socket connection that has the plug-and-socket connector and a mating connector associated with the plug-and-socket connector as a mating part to which the plug-and-socket connector can be attached in a plug-in direction. The invention additionally relates to an electrical plug-and-socket connection that has a plug-and-socket connector of the above-described type and a mating connector associated with the plug-and-socket connector as a mating part to which the plug-and-socket connector can be attached in a plug-in direction.

Description of the Background Art

Generally speaking, the invention relates to the field of electrical plug-and-socket connections, in particular multipole electrical plug-and-socket connections. It is known, for example from DE 44 20 984 C2, that such electrical plug-and-socket connections can be designed to be codable, wherein coding elements can be fastened in profiled grooves of the plug-and-socket connector.

SUMMARY OF THE INVENTION

It is therefore an object of the invention to further improve electrical plug-and-socket connections and their plug-and-socket connectors with regard to universal applicability and flexibility for the user.

This object is attained in an exemplary embodiment by a plug-and-socket connector for an electrical plug-and-socket connection that has the plug-and-socket connector and a mating connector associated with the plug-and-socket connector as a mating part to which the plug-and-socket connector can be attached in a plug-in direction, wherein the plug-and-socket connector has a housing and multiple electrical plug-in contacts that are arranged at least partially in the housing and that are arranged side by side in a row direction, wherein a first housing wall of the housing, which is arranged parallel to a plane spanned by the plug-in direction and the row direction, adjoins a second housing wall of the housing, which faces in the plug-in direction and is arranged at an angle to the first housing wall, having the following features: the first housing wall has at least one first receiving groove, with its longitudinal direction extending in the plug-in direction, for receiving a functional element, and the second housing wall has at least one second receiving groove for receiving a functional element.

This makes it possible for functional elements to be installed on the plug-and-socket connector from different directions. Moreover, an increase in the polarity of the coding of the plug-and-socket connector is possible.

The plug-and-socket connector according to the invention provides the user the possibility to equip the plug-and-socket connector with one or more functional elements as needed in a substantially more flexible way than is the case with the prior art. The plug-and-socket connector can thus be adapted to customer needs, or to the needs of the end user, to a substantially greater degree in the individual case without involving great effort. Moreover, there are advantages in terms of production because standardized plug-and-socket connectors can be provided for a multiplicity of applications, which connectors can be adapted by the customer or end user by inserting one or more functional elements into the first and second receiving grooves.

The first receiving groove and/or the second receiving groove in this case can be designed, in particular, as a universal receiving groove or as a universal fixing element for fixing in place a wide variety of functional elements that can be chosen by the user. Due to the arrangement of the first and the second receiving grooves in the region of the first and second housing walls, which are arranged at an angle to one another, the different functional elements can accordingly be fixed in place in this region of the housing, and thus in the vicinity of the mating face of the plug-and-socket connector. The region of a plug-and-socket connector that faces the mating connector in the plug-in direction and is mated with the mating connector is referred to as the mating face.

The functional elements can be designed for different functions of the plug-and-socket connector, for example as coding elements for coding the plug-and-socket connection, as interlocking elements for interlocking the plug-and-socket connector with the mating connector in order to prevent unintentional release, as labeling elements, or as other functional elements. In this context, coding means that a particular combination of coding elements, which is associated with a corresponding mating coding on the mating connector, is fastened to the plug-and-socket connector so that as a result of this coding, the plug-and-socket connector can only be attached to a mating connector that has the corresponding mating coding.

Another advantage of the invention is that the arrangement and position of functional elements fastened in the first and/or the second receiving groove is not permanently defined, but instead can also be changed later as needed. Thus, for example, a recoding of the plug-and-socket connector or a change in the interlocking type can be carried out later.

The second housing wall has, as already mentioned, the characteristic that it faces in the plug-in direction so that it is visible when the plug-and-socket connector is viewed from the mating face. In this case, the angle between the first housing wall and the second housing wall can be a right angle, for example. Alternatively, other angles can also be implemented, for example in the range from 45° to 135°. Accordingly, in such cases the second housing wall would be arranged obliquely to the first housing wall.

If the plug-and-socket connector has, for example, multiple first receiving grooves arranged side by side in the row direction and/or multiple second receiving grooves arranged side by side in the row direction, then functional elements can also be fastened over multiple grooves, for example in two or more first receiving grooves or in two or more second receiving grooves. Depending on the design of the functional elements, they can also be fastened in a combination of a first and a second receiving groove, in particular when the first and the second receiving grooves are aligned with one another or are at least close together.

Multiple functional elements can also be used in a first and/or second receiving groove in each case. For example, two functional elements can also be used in each pair composed of a first and a second receiving groove, e.g., one functional element in the first receiving groove and one functional element in the second receiving groove. In this way, the functional elements can brace against and secure one another.

According to an advantageous embodiment of the invention, provision is made that the first receiving groove intersects the plane of the outer surface of the second housing wall. The first receiving groove thus extends at least somewhat into the material of the second housing wall. This permits especially reliable fastening of functional elements in the first receiving groove.

According to an advantageous embodiment of the invention, provision is made that the second receiving groove intersects the plane of the outer surface of the first housing wall. The material of the second receiving groove thus extends at least somewhat into the material of the first housing wall. This permits especially reliable fastening of functional elements in the second receiving groove.

According to an advantageous embodiment of the invention, provision is made that the central axis of a first receiving groove is skew to a central axis of a second receiving groove. Accordingly, these central axes do not intersect. This applies, in particular, to first and second receiving grooves that are associated with one another.

According to an advantageous embodiment of the invention, provision is made that the first receiving groove is connected to the second receiving groove in an intersection region, or is designed to be separate from the second receiving groove. If the first receiving groove is designed to be separate from the second receiving groove, then a separating web, for example, can be formed between the first and the second receiving grooves by the material of the first housing wall and/or of the second housing wall. If the first receiving groove has an intersection region with the second receiving groove, then the first receiving groove transitions into the second receiving groove as a result. This creates an angular space in the corner region, which is to say in the intersection region of the first and the second receiving grooves, providing additional advantageous fastening options for functional elements.

As a result of the connection of the first receiving groove with the second receiving groove, the advantageous possibility is created to install functional elements there from two directions, each of which elements can use the connected space (angular space) and thus a part of the respective adjoining other receiving groove. Because of the connection of the first receiving groove with the second receiving groove, the fixing of a functional element that is installed in the first receiving groove extending in the plug-in direction, for example, can extend outward through the adjacent space, thus permitting, e.g., a coding element located toward the outside that is fixed at the inside in this case and can be installed in the plug-in direction.

As a result of the second receiving groove, it is possible in particular to advantageously fasten functional elements whose fastening units extend into the first receiving groove. In particular, the receiving of functional elements such as interlocking units or latches is especially advantageous in this design. With the aid of a support geometry on a functional element, it is then possible to absorb the torques that act on the second receiving groove under tensile loading by the means that the support geometry grips beneath the housing of the mating connector and thus prevents the functional element from rotating out.

According to an advantageous embodiment of the invention, provision is made that the first receiving groove and/or the second receiving groove has a profile with at least one undercut. This permits reliable fastening of functional elements in the first and/or the second receiving groove. The profile can be a dovetail profile or a T-shaped profile, for example.

According to an advantageous embodiment of the invention, provision is made for one, several, or all first receiving grooves that each first receiving groove is spatially associated with one plug-in contact of the plug-and-socket connector. This can be achieved, for example, by the means that a given first receiving groove is aligned in the longitudinal direction with an electrical plug-in contact with which the first receiving groove is associated. By this means, good utilization of space for the installation of a multiplicity of functional elements on the housing of the plug-and-socket connector, and thus a multiplicity of possibilities for combination of the functional elements, is created.

According to an advantageous embodiment of the invention, provision is made for one, several, or all second receiving grooves that each second receiving groove is spatially associated with one plug-in contact of the plug-and-socket connector. This can be achieved, for example, by the means that in each case, the second receiving groove is aligned in the longitudinal direction with an electrical plug-in contact with which the second receiving groove is associated. By this means, good utilization of space for the installation of a multiplicity of functional elements on the housing of the plug-and-socket connector, and thus a multiplicity of possibilities for combination of the functional elements, is created.

For one, several, or all plug-in contacts, the housing of the plug-and-socket connector can have conductor insertion openings through which electrical conductors (cables) that are to be connected to the plug-in contact can be passed through the housing to the plug-in contact. One conductor insertion opening can be present for each plug-in contact, or a combined conductor insertion opening for multiple plug-in contacts, also in combination with individual conductor insertion openings. The conductor insertion openings are distributed over one housing side or on multiple housing sides that are not the side with the mating face of the plug-and-socket connector.

According to an advantageous embodiment of the invention, provision is made that one, several, or all plug-in contacts each have a fastening element for fastening an electrical conductor to the plug-in contact, wherein at least a part of the fastening element is arranged in a base-like section of the housing that is bounded toward the mating face by the second housing wall. In this way, good utilization of the space of the housing of the plug-and-socket connector can be achieved. The fastening element can be, for example, a screw fastening element or a spring-loaded fastening element, for example in the form of a cage clamp. The fastening elements of the plug-and-socket connector in this design can be identical or different in design, for example in accordance with one of the aforementioned principles.

According to an advantageous embodiment of the invention, provision is made that the first receiving groove and/or the second receiving groove is designed as a universal fixing element for fixing in place different functional elements to be chosen by the user.

Each first receiving groove can have a second receiving groove spatially associated with it, for example by the means that the first and the second receiving grooves that are associated with one another are located close together. In the case of such first and second receiving grooves associated with one another, they can each have the same profile cross-section or can have different profile cross-sections, for example different widths or different depths of the grooves.

According to an advantageous embodiment of the invention, provision is made that relevant center planes of the first and the second receiving grooves extending in the longitudinal direction of the first and the second receiving grooves are coplanar with or parallel to one another. In this way, a first receiving groove can be spatially associated with a second receiving groove. The longitudinal direction of the first receiving groove is understood here to mean the direction in which the first receiving groove extends away from the second housing wall. The longitudinal direction of the second receiving groove is understood here to mean the direction in which the second receiving groove extends away from the first housing wall. The center plane of a relevant receiving groove is understood to mean a plane that is perpendicular to the row direction and passes centrally through the relevant receiving groove in its longitudinal direction. This allows additional advantageous fastening options of the functional elements on the first and second receiving grooves.

According to an advantageous embodiment of the invention, provision is made that the second receiving groove is aligned with the first receiving groove. In this way, a first receiving groove can be spatially associated with a second receiving groove. This allows additional advantageous fastening options of the functional elements on the first and second receiving grooves.

According to an advantageous embodiment of the invention, provision is made that the plug-and-socket connector is assembled in multiple parts from individual plug-and-socket connector segments, wherein each plug-and-socket connector segment has its own housing and the housing of the plug-and-socket connector is made at least partly of the assembled housings of the plug-and-socket connector segments. In this case, the plug-and-socket connector can have plug-and-socket connector segments with their own housings that each have a first and a second receiving groove as explained above. The plug-and-socket connector can also have plug-and-socket connector segments with their own housings that do not have such receiving grooves or that have only a first or only a second receiving groove of the above-described type. In this way the housing of the plug-and-socket connector can be made variably with different configurations of first and second receiving grooves as needed by the user. In particular, the plug-and-socket connector can be composed exclusively of plug-and-socket connector segments with a first and a second receiving groove in each case. This results in maximum choice on the part of the user for the attachment of functional elements to the plug-and-socket connector.

The invention additionally relates to an electrical plug-and-socket connection that has a plug-and-socket connector of the above-described type and a mating connector associated with the plug-and-socket connector as a mating part to which the plug-and-socket connector is attached or can be attached in a plug-in direction. The advantages explained above can be attained by this means as well.

According to an advantageous embodiment of the invention, provision is made that the mating connector has a housing and multiple electrical plug-in contacts located at least partly in the housing that are arranged side by side in a row direction, wherein a third housing wall of the housing of the mating connector, which is parallel to a plane spanned by the plug-in direction and the row direction, adjoins a fourth housing wall of the housing of the mating connector, which faces in the plug-in direction and is arranged at an angle to the third housing wall, having the following features: the third housing wall has at least one third receiving groove, with its longitudinal direction extending in the plug-in direction, for receiving a functional element, and the fourth housing wall has at least one fourth receiving groove for receiving a functional element.

In this way, the mating connector can be improved advantageously in a manner comparable to that previously described for the plug-and-socket connector. Thus, all features previously explained for the plug-and-socket connector can be implemented in like manner on the mating connector, wherein in the case of the mating connector the third housing wall corresponds to the first housing wall of the plug-and-socket connector, and the fourth housing wall corresponds to the second housing wall of the plug-and-socket connector. Accordingly, in the case of the mating connector, the third receiving groove corresponds to the first receiving groove of the plug-and-socket connector and the fourth receiving groove corresponds to the second receiving groove of the plug-and-socket connector.

The invention also relates to a set composed of at least one plug-and-socket connector of the above-described type and at least one functional element that has at least one fastening region that can be fastened in the first receiving groove and/or the second receiving groove. The advantages explained above can be attained by this means as well.

For the purposes of the present invention, the indefinite article "a" is not to be understood as a number. Thus, for example, if reference is made to "a component," this is to be interpreted in the sense of "at least one component." If angles are specified in degrees, these specifications refer to a circular measurement of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
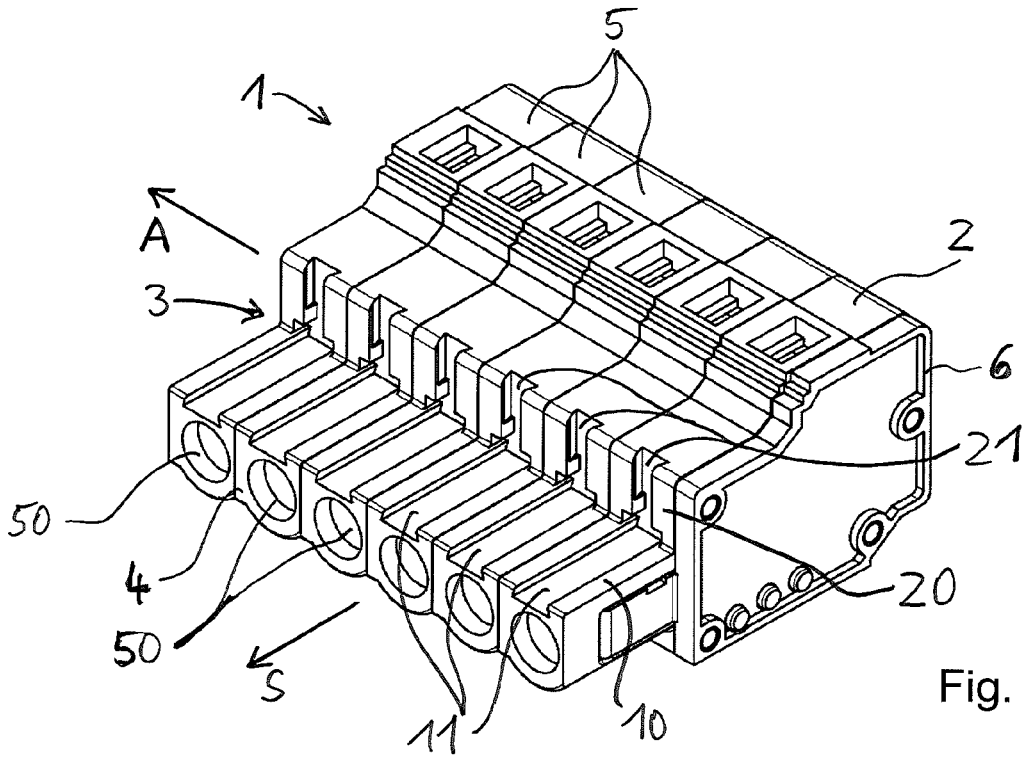
FIG. 1 shows a plug-and-socket connector in a perspective representation.

FIG. 1 shows a plug-and-socket connector 1, which has a housing 2. The plug-and-socket connector 1 is composed, for example, of multiple individual plug-and-socket connector segments, each of which has its own housing 5. The plug-and-socket connector segments, or their housings 5, are arranged side by side in a row direction A and fastened together, for example by latching to one another. The row of individual housings 5 is terminated on one side by an end plate 6. Alternatively, the plug-and-socket connector 1 can also be designed with a continuous housing 2. The end plate 6 is an optional component that is not necessary in all cases.

The row direction A defines, in particular, the arrangement in which the electrical plug-in contacts of the plug-and-socket connector 1 are arranged next to one another in the housing 2. In the specific exemplary embodiment shown in FIG. 1 with multiple housings 5, this also represents the row direction of the housings 5.

The housing 2 has a step 3 that faces in the plug-in direction S. The step 3 is formed from housing walls adjacent to one another, specifically a first housing wall 10 that is parallel to a plane spanned by the plug-in direction S and the row direction A, and a second housing wall 20 that adjoins the first housing wall 10. The second housing wall 20 likewise faces in the plug-in direction S and is arranged at an angle to the first housing wall 10, for example at a right angle.

In the specific exemplary embodiment shown in FIG. 1 with the individual housings 5, the first housing wall 10 is formed by relevant individual first housing wall segments of the individual housings 5, and the second housing wall 20 is formed by individual second housing wall segments of the housings 5.

The plug-and-socket connector 1, or its housing 2, terminates in the plug-in direction S at the mating face 4. From the side of the mating face 4, relevant contact openings 50 lead to the electrical plug-in contacts of the plug-and-socket connector 1 located in the housing 2.

The housing 2 has first receiving grooves 11 in the first housing wall 10 and second receiving grooves 21 in the second housing wall 20 for fastening of functional elements. The first receiving grooves 11 extend with their longitudinal direction in the plug-in direction S. The second receiving grooves 21 in this exemplary embodiment extend with their longitudinal direction perpendicular to the plane spanned by the plug-in direction S and the row direction A.

Figure 2:
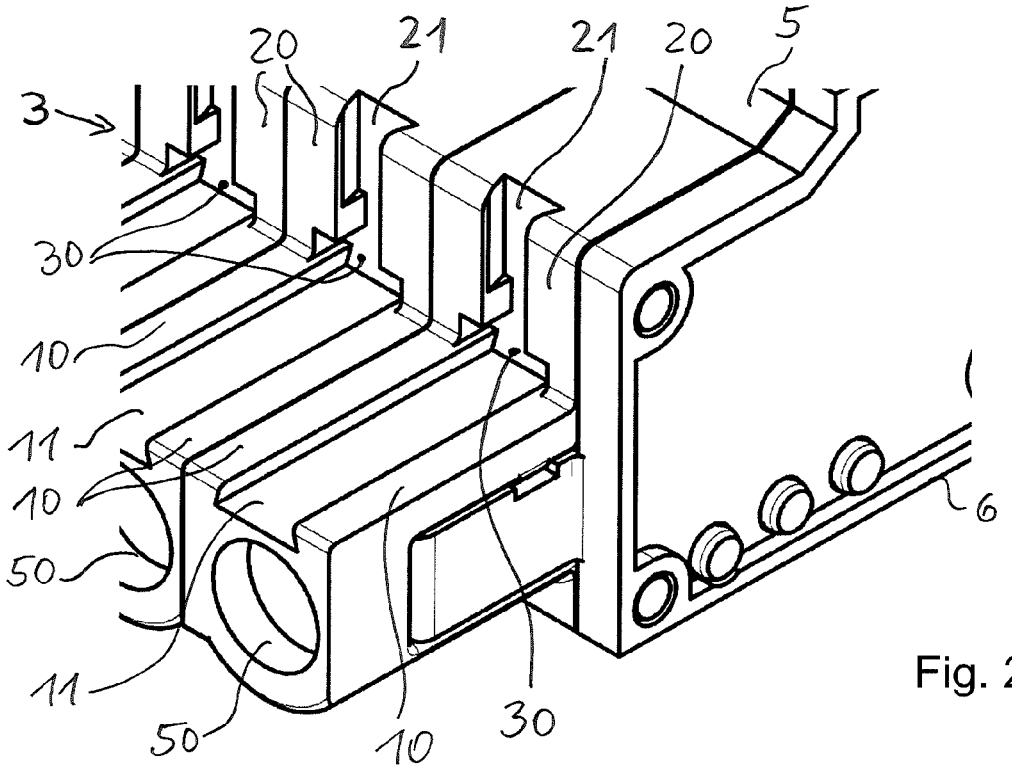
FIG. 2 shows an enlarged detail from FIG. 1.

For clarification of the first and the second receiving grooves 11, 21, FIG. 2 shows a detail of FIG. 1 that is enlarged in this respect. It is evident that the relevant first receiving groove 11 transitions into the relevant associated second receiving groove 21. This creates an intersection region 30 and thus an angular receiving space.

Figure 3:
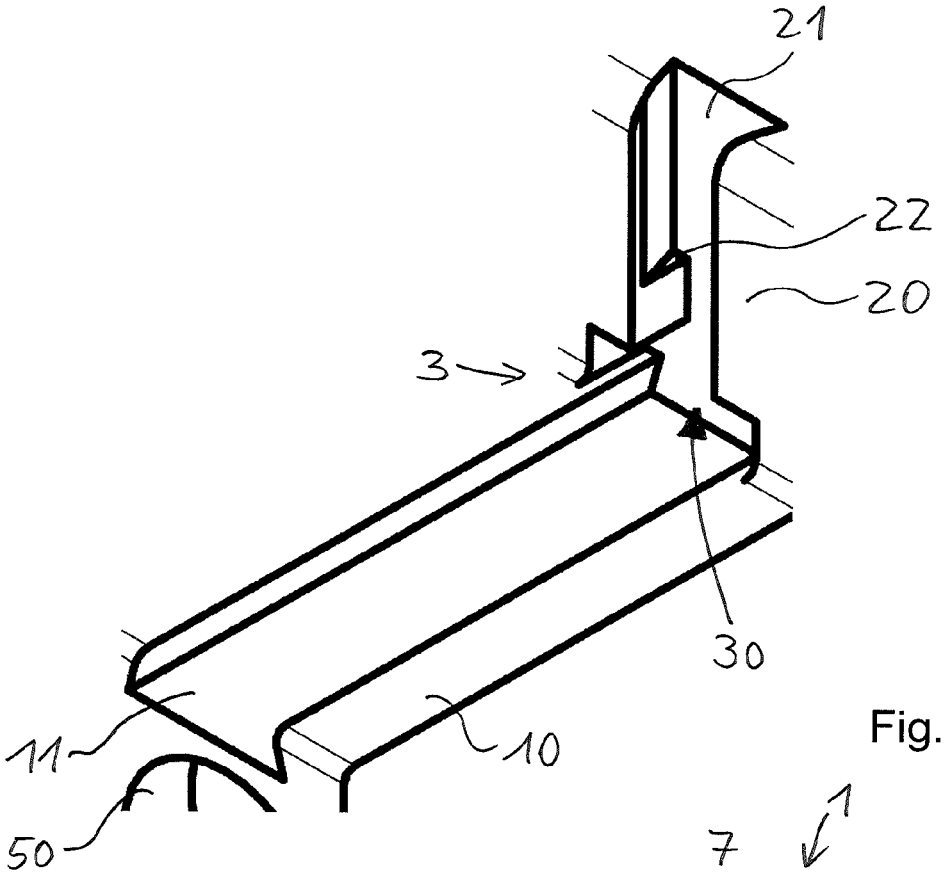
FIG. 3 shows a further enlarged detail from FIG. 2.

FIG. 3 shows a further enlargement of a detail in which is evident the arrangement of a first receiving groove 11 and a second receiving groove 21 associated therewith. Once again, the intersection region 30 between the receiving grooves 11, 21 is evident. It is also evident that the second receiving groove 21 can have a narrowing 22 at which the profile cross-section of the second receiving groove 21 is reduced. This creates a stop by which the engaged length of a functional element inserted in the second receiving groove 21 is limited. The first receiving groove 11 can be equipped with such a narrowing in a manner comparable to the second receiving groove 21. An undercut is provided on the surface of the narrowing 22 that forms the stop, on the side facing away from said stop in the direction of insertion of the receiving groove 21. This undercut can form a latching element, designed as a latching edge, for a functional element 8 inserted in the receiving groove 1, wherein the functional element 8 can have a mating latching element corresponding to the latching element of the guide groove 21.

Figure 4:
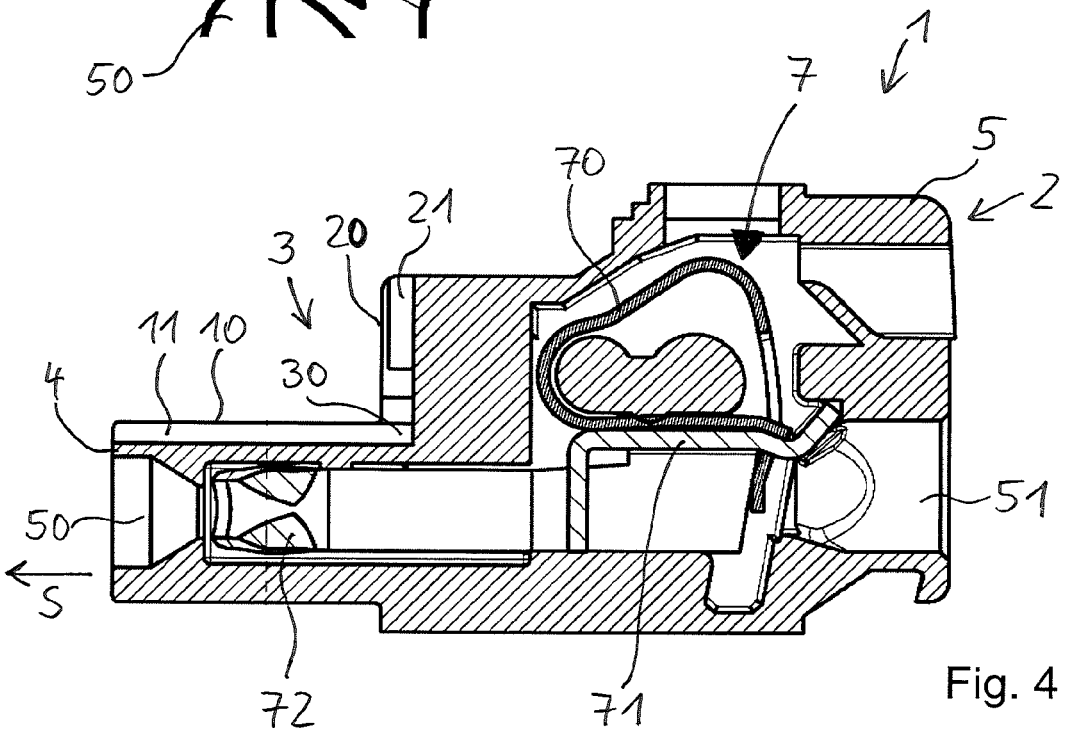
FIG. 4 shows the plug-and-socket connector from FIG. 1 in a sectional side view.

In the sectional representation in FIG. 4, an electrical plug-in contact 72 located in the housing 2 is evident. Also evident are elements of a contact insert that serve to electrically and mechanically connect an electrical line, which can be inserted through a conductor insertion opening 51 of the housing 2, to the plug-in contact 72. The contact insert can have, in particular, a fastening element 7 with which the electrical conductor can be fastened to the plug-in contact 72. The design of the fastening element 7 as a spring-loaded terminal is shown by way of example in FIG. 4. The spring-loaded terminal has a clamping spring 70, which is implemented here as a cage clamp by way of example, and a busbar 71. The busbar 71 is connected in an electrically conducting manner to the plug-in contact 72. An electrical conductor can be clamped to the busbar 71 by means of the clamping spring 70.

Figure 5:
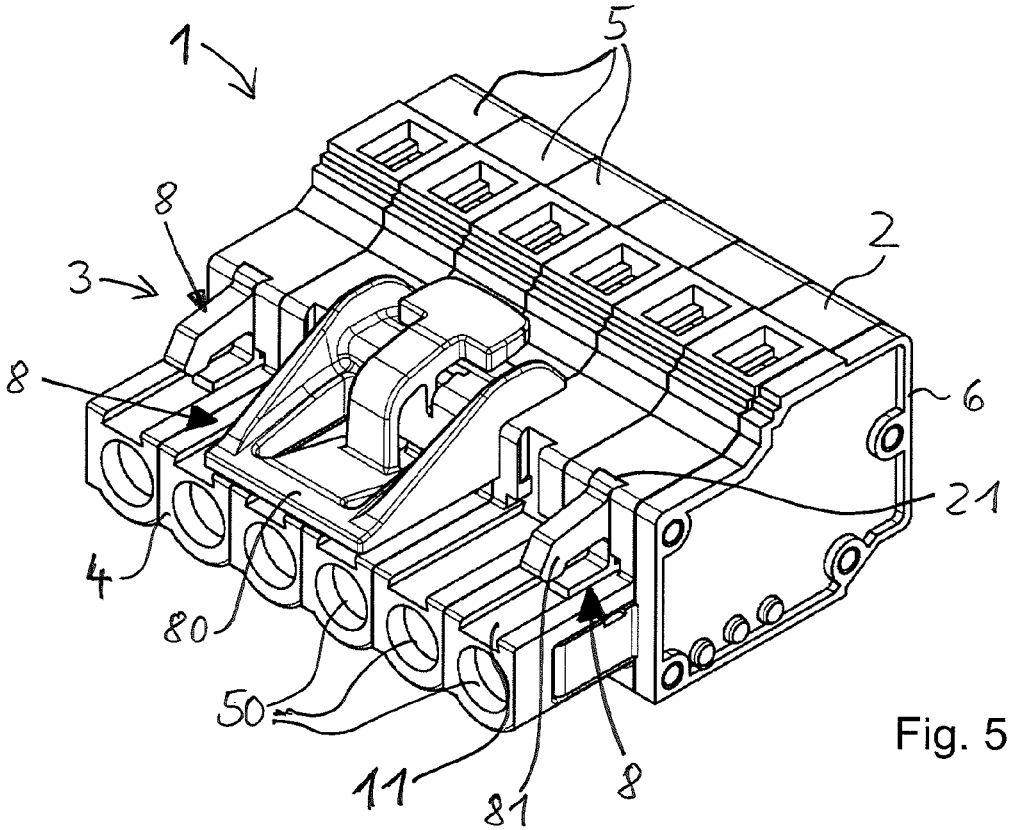
FIG. 5 shows a plug-and-socket connector with functional elements fastened thereto in a perspective representation.
Figure 6:
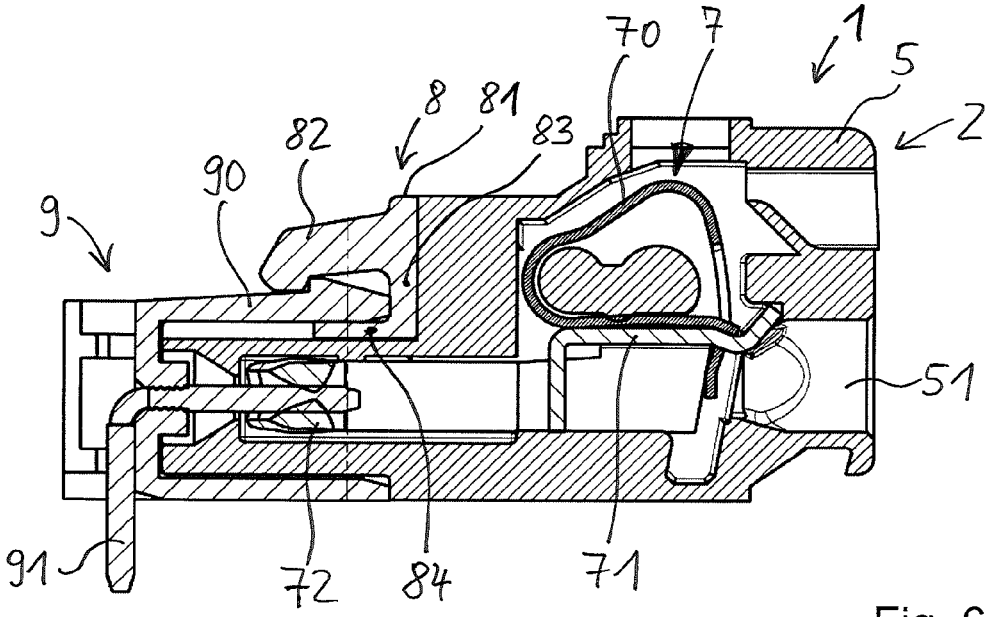
FIG. 6 shows an electrical plug-and-socket connection in a cross-sectional side view.
Figure 7:
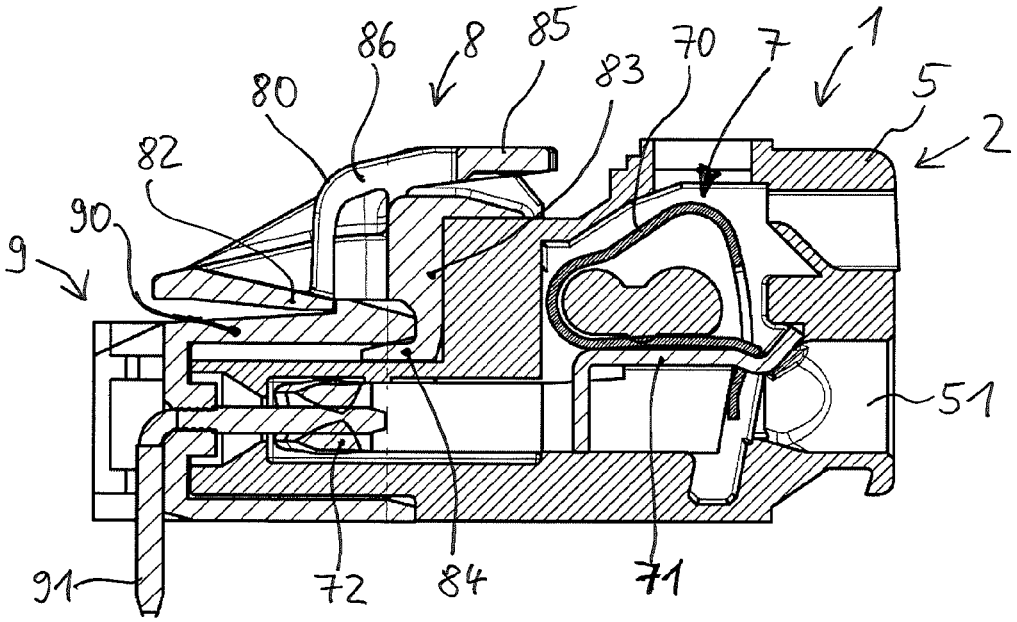
FIG. 7 shows another electrical plug-and-socket connection in a cross-sectional side view.

FIG. 5 shows the plug-and-socket connector from FIG. 1, wherein two differently designed functional elements 8 are fastened to the plug-and-socket connector 1. The functional elements 8 are fastened to the plug-and-socket connector 1 in that they are fastened by appropriately shaped fixing elements to the first receiving groove 11 and/or to the second receiving groove 21. The functional element 8 that can be seen further to the front is a first latching element 81 for latching of the plug-and-socket connector 1 with a mating connector. The functional element 8 that can be seen further to the rear is a second latching element 80 with a manual actuator, with which latching with a mating connector can likewise be established, and can be released again by means of the manual actuator. The further construction of the first latching element 81 is described based on the sectional representation 6 explained below, and the construction of the second latching element 80 is described based on the sectional representation in FIG. 7. FIGS. 6 and 7 correspond in this regard to the representation from FIG. 4, wherein in addition to the relevant functional elements 8 a mating connector 9 is also shown, with which the plug-and-socket connector 1 is mated. The mating connector 9 likewise has electrical plug-in contacts 91 and one or more latching elements 90.

It can be seen from FIG. 6 that the first latching element 81 has a second fastening section 83 fastened in the second receiving groove 21 and a first fastening section 84 fastened in the first receiving groove 11. The fastening sections 83, 84 can be designed to be separate or, as shown, contiguous. The first latching element 81 here is inserted with the first fastening section 83 into the second receiving groove 21 in a direction perpendicular to the plane formed by the row direction A and the plug-in direction S. The second receiving groove 21 and the first fastening section 83 form a positive-locking connection here, for example in the manner of a dovetail guide. In the installed position, the second fastening section 84 of the first latching element 81 forms a support for the first latching element 81 in the first receiving groove 11 as well as a rest and/or support for the latching element or elements 90 of the mating connector 9. The first latching element 81 has a latching arm 82 projecting in the plug-in direction S that, together with the latching element 90, establishes latching between the plug-and-socket connector 1 and the mating connector 9. As a result of the latching, the plug-and-socket connector 1 cannot come loose from the mating connector 9 readily.

As a result of the visible fixing in place of the first latching element 81 by means of the angled fastening regions 83, 84, an especially reliable fixing onto the plug-and-socket connector is achieved, since a type of support geometry is provided in this way that absorbs the torques acting on the receiving grooves 11, 21 under tensile loading, and thus prevents release of the functional element 8 in the sense of rotating out. Due to the support of the latching element 90 of the mating connector 9 on the second fastening section 84 of the first latching element, moreover, the first latching element 81 is held securely in the receiving grooves 11, 21; in particular, the first latching element 81 cannot slide out of the second receiving groove 21 opposite the direction of insertion.

FIG. 7 again shows the plug-and-socket connector 1, which is mated with the mating connector 9. The second latching element 80 is visible, which again, analogously to the above-described latching element 81, has the fastening regions 83, 84, which can be designed identically or at least similarly to those in the first latching element 81. The second latching element 80 likewise has a latching arm 82, which, with the latching element 90, produces a latching of the plug-and-socket connector 1 to the mating connector 9. In addition, the second latching element 80 has a manual actuator 85 that is connected to the latching arm 82 through a connecting arm 86. When pressure is applied to the manual actuator 85 from above, the connecting arm 86 redirects this motion so that the latching arm 82 is deflected upward and thus is no longer in engagement with the latching element 90. In this way the plug-and-socket connector 1 can be released from the mating connector 9.

As FIGS. 5 to 7 also show, a functional element 8 can be fastened to only one arrangement of first receiving groove 11 and associated second receiving groove 21. A functional element 8 can additionally be fastened to multiple first and second receiving grooves 11, 21. Alternatively, a functional element can also be fastened to only one first receiving groove 11 or to multiple first receiving grooves 11, or to only one second receiving groove 21 or multiple receiving grooves 21.

Figure 8:
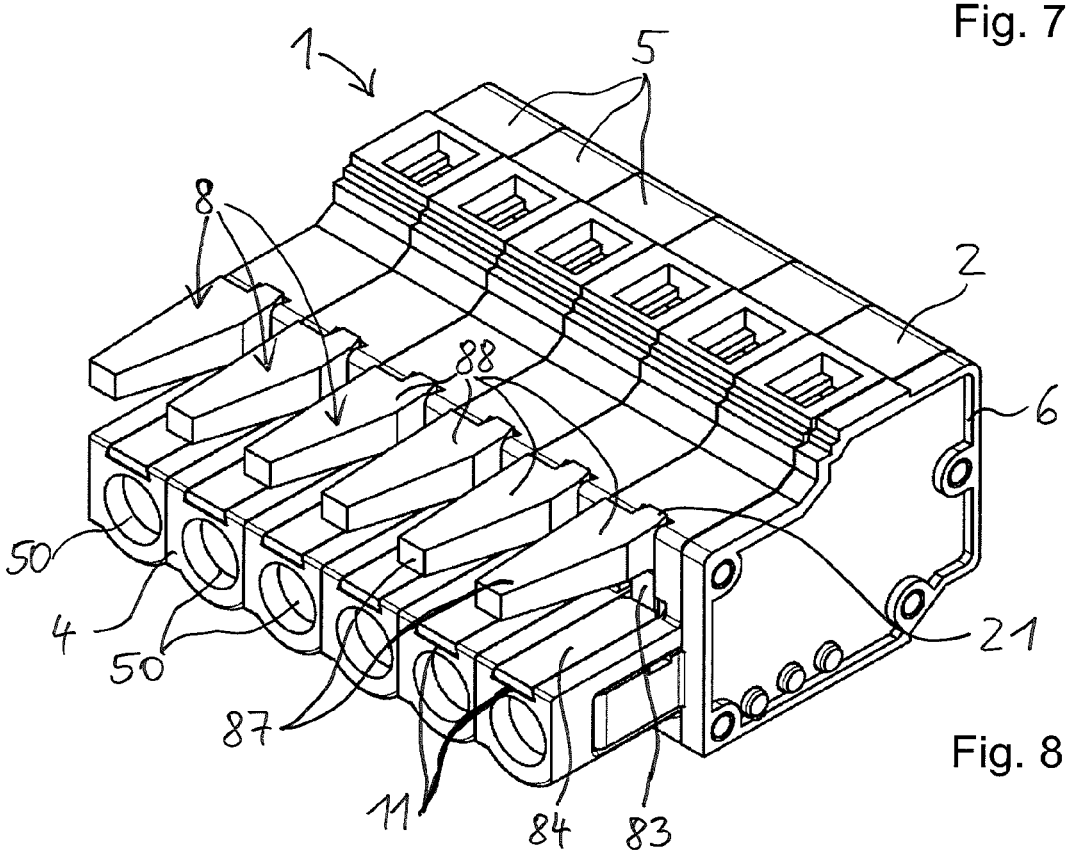
FIG. 8 shows a plug-and-socket connector with functional elements installed thereon in a perspective representation.

FIG. 8 shows a plug-and-socket connector 1, wherein differently designed functional elements 8 are in turn fastened to the first and second receiving grooves 11, 21. The functional elements 8 shown in FIG. 8 by way of example are coding elements 88, with which a coding of the plug-and-socket connector 1 can be achieved.

It is evident in FIG. 8 that the coding elements 88 once again have a second fastening region 83 fastened in the second receiving groove 21 and a first fastening region 84 connected thereto that is fastened in the first receiving groove 11. In this way, the above-described effect of the support geometry, and thus the reduction of loading by torques, is likewise achieved. In advantageous manner, the coding elements 88 are inserted by a first fastening region 84 into the first receiving grooves 11 opposite the plug-in direction S, for example with a positive-locking dovetail guide. The second fastening region 83 of the coding elements 88 is then braced in the second receiving grooves 21 in the installed position. In addition, the coding elements 88 can bear or brace against the second housing wall 20 of the housing 2 of the plug-and-socket connector of the housing 5 of the plug-and-socket connector segment with a surface that is set back with respect to the second fastening region 81. In this design, the coding elements 88 can each have coding projections 87 that project in the plug-in direction S, by means of which a first coding of a coding element 88 is created. A second coding of the coding element 88 can be created by the length of the first fastening regions 84. If the first fastening regions 84 are made relatively long, for example over the entire longitudinal extent of the first receiving groove 11, they can achieve a different coding than if they are designed to be correspondingly shorter, for example over only a quarter of the length of the first receiving groove 11. In a comparable manner, the length of the coding projection 87 can be made different, which is to say that a different coding is achieved with a coding projection 87 designed to be long than with a coding projection designed to be accordingly shorter or with an omission of the coding projection 87.

In the embodiments described thus far, the first receiving groove 11 and the second receiving groove 21 that are associated with one another were in each case designed such that one receiving groove ends at the base of the respective other receiving groove in the intersection region 30. Such an embodiment is not mandatory, however. The first and/or the second receiving groove 11, 21 can also be extended further in this intersection region 30 so that it continues beyond the base of the respective other associated receiving groove. In this way a recess is formed in the base of the respective perpendicular receiving groove. Such a recess can be used to receive an end of a functional element. This end of the functional element can be received in the respective recess in a latching manner (latching edges) and/or in a clamping manner. In this way pull-out forces and/or torques acting on the functional element can be absorbed and neutralized.

Such embodiments of the intersection region 30 will be described in detail by way of example on the basis of the following embodiments described by FIGS. 9 to 14.

Figure 9:
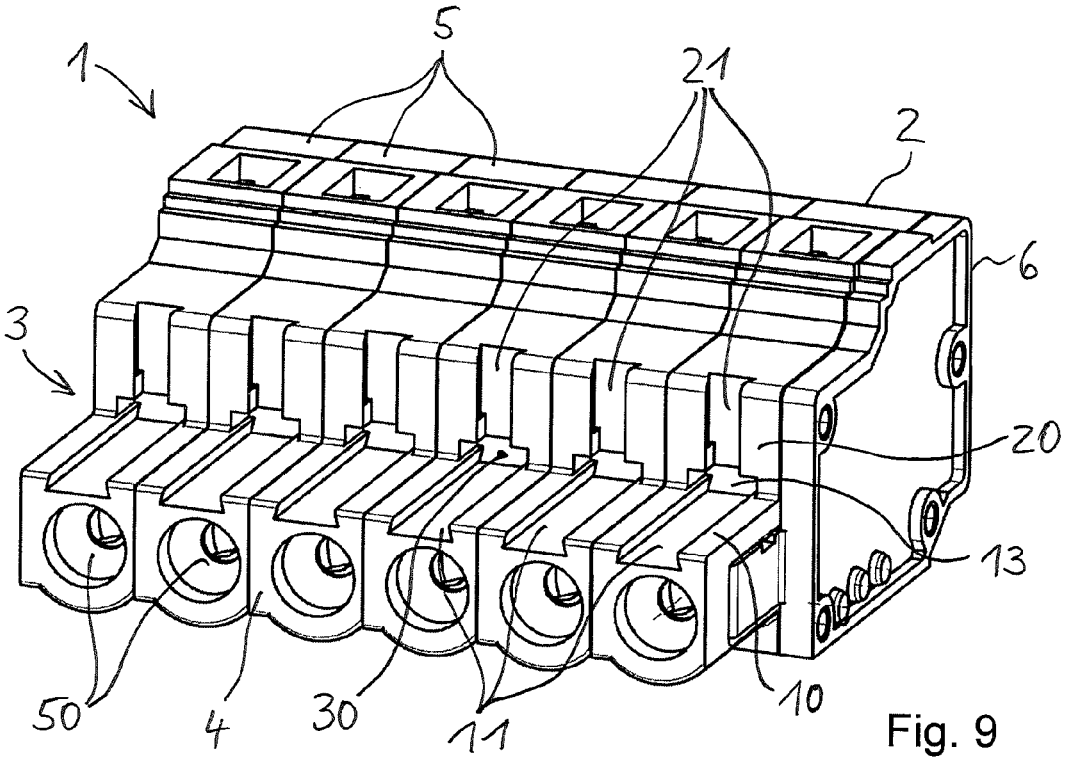
FIG. 9 shows a plug-and-socket connector in a perspective representation.
Figure 10:
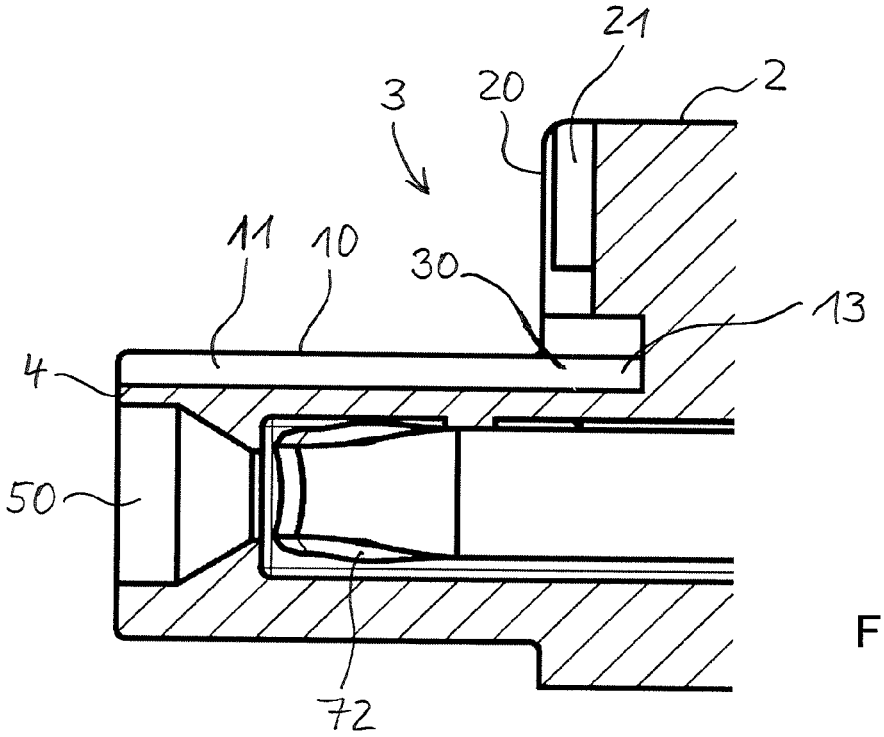
FIG. 10 shows the plug-and-socket connector from FIG. 9 in a sectional side view.

In the embodiment from FIGS. 9 and 10, the first receiving groove 11 extends beyond the base of the second receiving groove 21 with a first extension section 13, which is to say that the intersection region 30 is extended somewhat opposite the plug-in direction S and projects further into the material of the housing 2. In this way, a recess is formed in the base of the second receiving groove 21.

Figure 11:
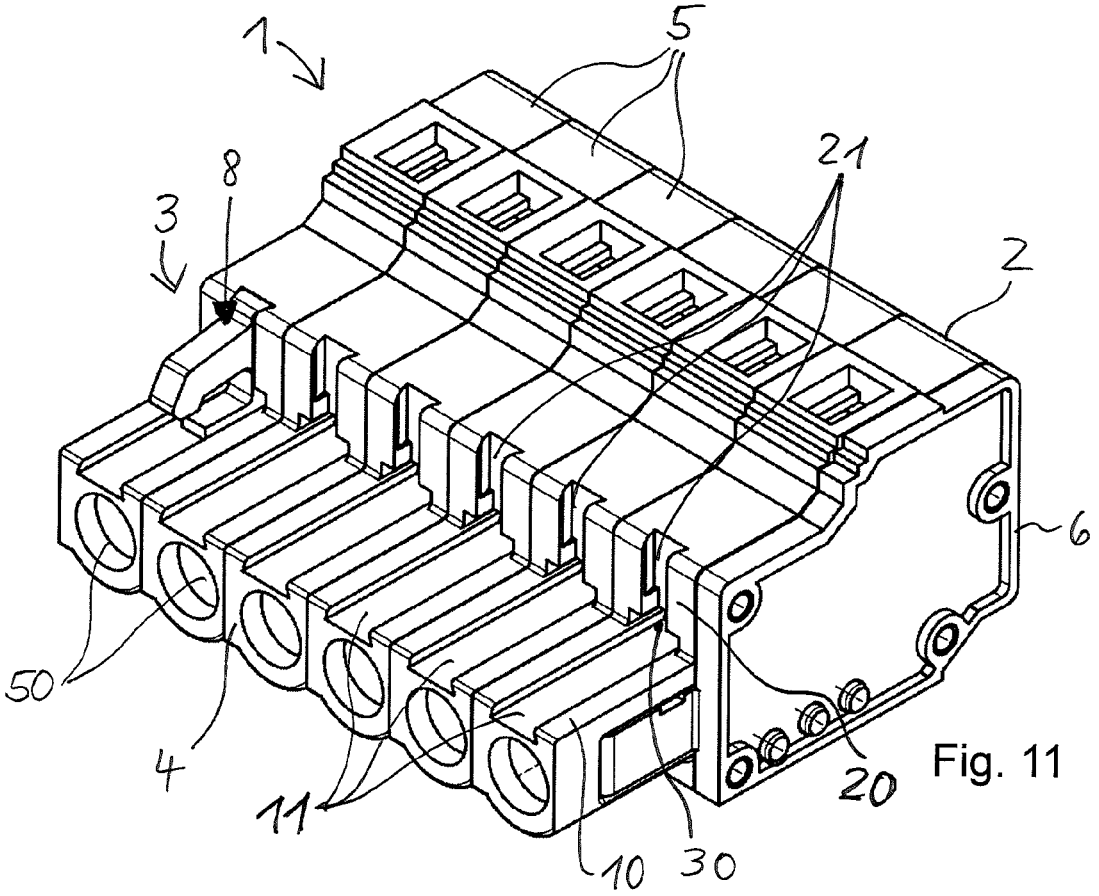
FIG. 11 shows a plug-and-socket connector in a perspective representation.
Figure 12:
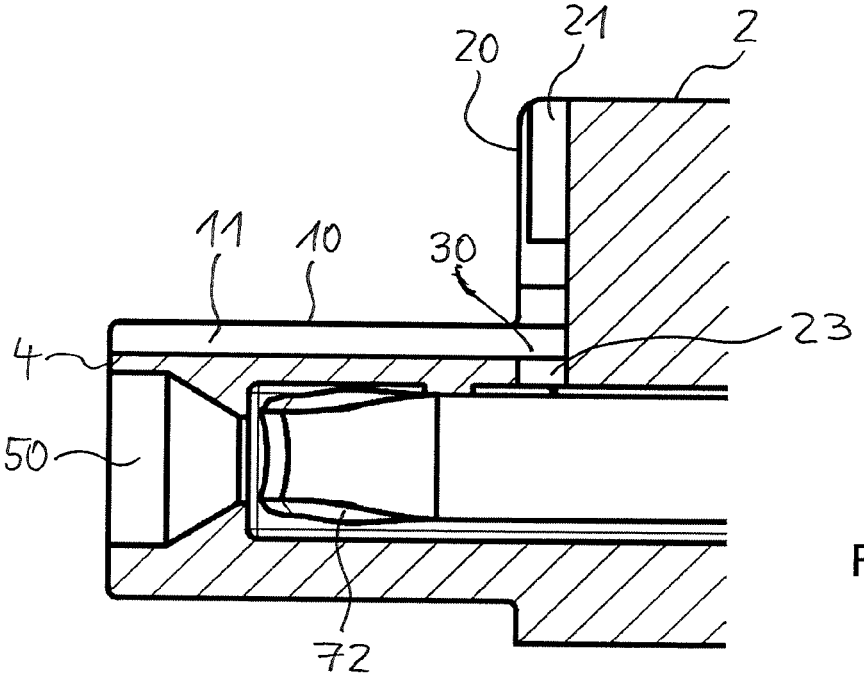
FIG. 12 shows the plug-and-socket connector from FIG. 11 in a sectional side view.

FIGS. 11 and 12 show an embodiment in which the second receiving groove 21 is designed to be extended by a second extension section 23, which is to say that it extends beyond the base of the first receiving groove 11 in the intersection region 30. In this way, a recess is formed in the base of the first receiving groove 11.

Figure 13:
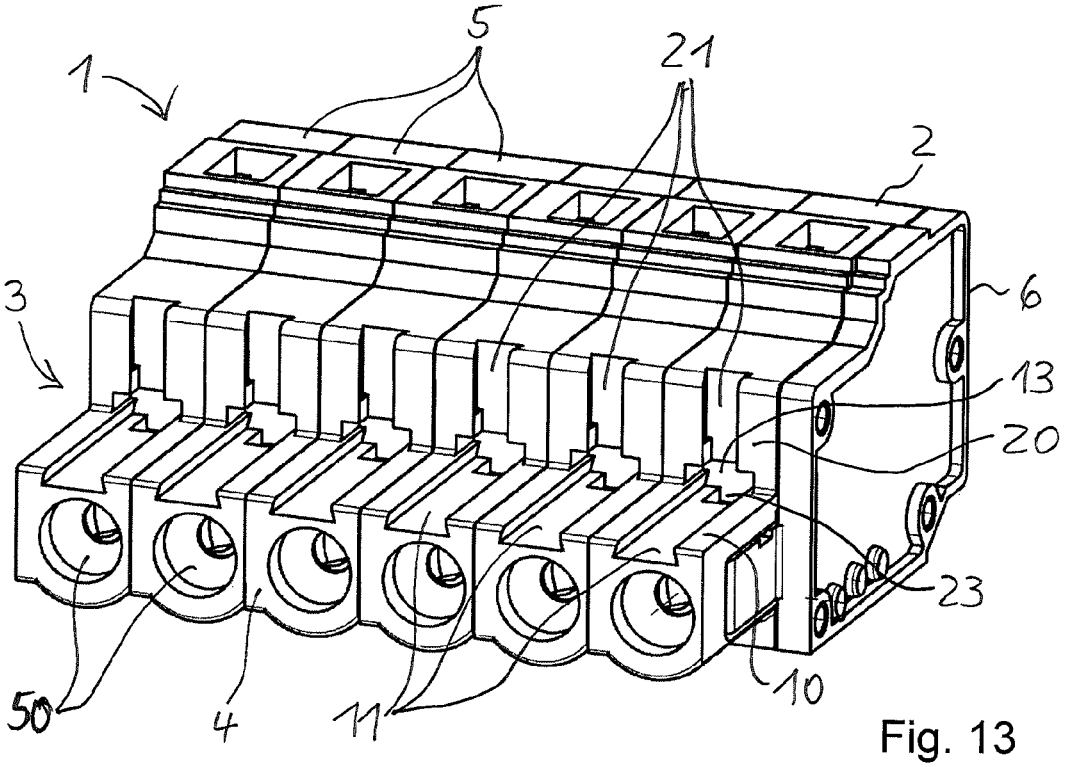
FIG. 13 shows a plug-and-socket connector in a perspective representation.
Figure 14:
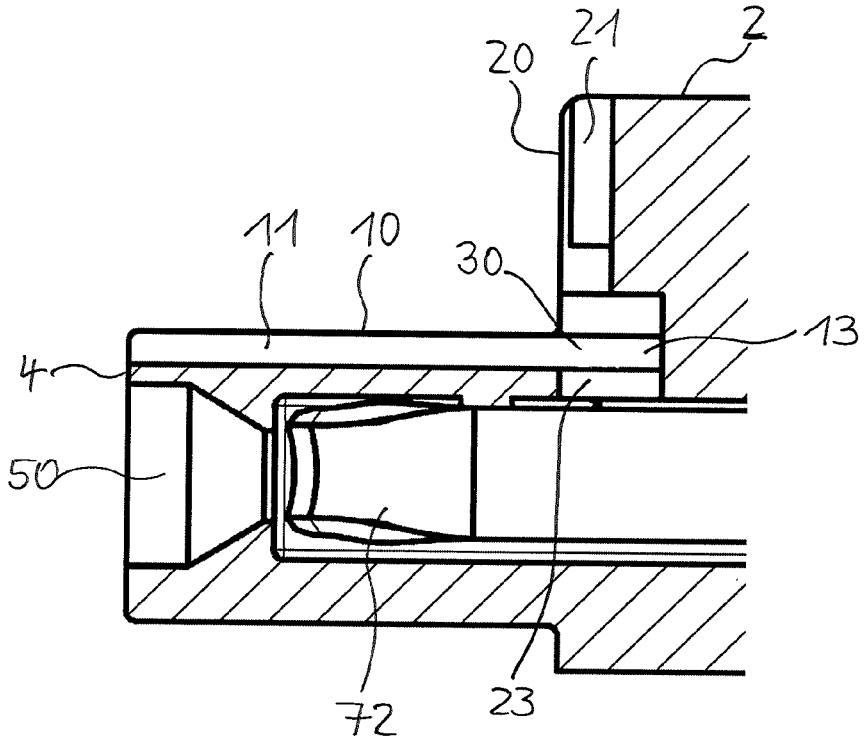
FIG. 14 shows the plug-and-socket connector from FIG. 13 in a sectional side view.

FIGS. 13 and 14 show an embodiment in which the respective extended first and second receiving grooves 11, 12, as they were described based on FIGS. 9 to 12, are implemented in combination with one another. The first receiving groove 11 thus extends beyond the base of the second receiving groove 21 in the intersection region 30 with the first extension section 13. The second receiving groove 21 extends beyond the base of the first receiving groove 11 in the intersection region 30 with the second extension section 23. In this way, recesses are formed not only in the base of the first receiving groove 11 but also in the base of the second receiving groove 21.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A plug-and-socket connector for an electrical plug-and-socket connection that has the plug-and-socket connector and a mating connector associated with the plug-and-socket connector as a mating part to which the plug-and-socket connector is adapted to be attached in a plug-in direction, the plug-and-socket connector comprising:

a housing; and a plurality of electrical plug-in contacts arranged at least partially in the housing and arranged side by side in a row direction, wherein a first housing wall of the housing, which is arranged parallel to a plane spanned by the plug-in direction and the row direction, adjoins a second housing wall of the housing, which faces in the plug-in direction and is arranged at an angle to the first housing wall, wherein the first housing wall has at least one first receiving groove with its longitudinal direction extending in the plug-in direction for receiving a functional element, and wherein the second housing wall has at least one second receiving groove for receiving a functional element.

2. The plug-and-socket connector according to claim 1, wherein the second housing wall is arranged at right angles to the first housing wall.

3. The plug-and-socket connector according to claim 1, wherein the first receiving groove intersects a plane of an outer surface of the second housing wall.

4. The plug-and-socket connector according to claim 1, wherein the second receiving groove intersects a plane of an outer surface of the first housing wall.

5. The plug-and-socket connector according to claim 1, wherein the first receiving groove is connected to the second receiving groove in an intersection region or is designed to be separate from the second receiving groove.

6. The plug-and-socket connector according to claim 1, wherein the first receiving groove and/or the second receiving groove has a profile with at least one undercut.

7. The plug-and-socket connector according to claim 1, wherein one, several, or all first receiving grooves are spatially associated with one plug-in contact of the plug-and-socket connector.

8. The plug-and-socket connector according to claim 1, wherein one, several, or all second receiving grooves are spatially associated with one plug-in contact of the plug-and-socket connector.

9. The plug-and-socket connector according to claim 1, wherein one, several, or all plug-in contacts have a fastening element for fastening an electrical conductor to the plug-in contact, wherein at least a part of the fastening element is arranged in a base-like section of the housing that is bounded toward the mating face by the second housing wall.

10. The plug-and-socket connector according to claim 1, wherein the first receiving groove and/or the second receiving groove is designed as a universal fixing element for fixing in place different functional elements to be chosen by the user.

11. The plug-and-socket connector according to claim 1, wherein relevant center planes of the first and the second receiving grooves extending in the longitudinal direction of the first and the second receiving grooves are coplanar with or parallel to one another.

12. The plug-and-socket connector according to claim 1, wherein the second receiving groove is aligned with the first receiving groove.

13. The plug-and-socket connector according to claim 1, wherein the plug-and-socket connector is assembled in multiple parts from individual plug-and-socket connector segments, wherein each plug-and-socket connector segment has its own housing and the housing of the plug-and-socket connector is made at least partly of the assembled housings of the plug-and-socket connector segments.

14. An electrical plug-and-socket connection comprising:

a plug-and-socket connector according to claim 1; and a mating connector associated with the plug-and-socket connector as a mating part to which the plug-and-socket connector is attached or adapted to be attached in a plug-in direction.

15. The electrical plug-and-socket connection according to claim 14, wherein the mating connector has a housing and multiple electrical plug-in contacts located at least partly in the housing that are arranged side by side in a row direction, wherein a third housing wall of the housing of the mating connector, which is parallel to a plane spanned by the plug-in direction and the row direction, adjoins a fourth housing wall of the housing of the mating connector, which faces in the plug-in direction is arranged at an angle to the third housing wall, wherein the third housing wall has at least one third receiving groove, with its longitudinal direction extending in the plug-in direction for receiving a functional element, and wherein the fourth housing wall has at least one fourth receiving groove for receiving a functional element.

16. A set comprising:

at least one plug-and-socket connector according to claim 1; and at least one functional element that has at least one fastening region that is adapted to be fastened in the first receiving groove and/or the second receiving groove.

17. The plug-and-socket connector according to claim 1, wherein the housing comprises a third housing wall adjoining the second housing wall and forming an angle with the second housing wall, and wherein a second mounting channel ends at the third housing wall.

18. The plug-and-socket connector according to claim 17, wherein the second mounting channel has an open end at the third housing wall.

19. The plug-and-socket connector according to claim 1, wherein the longitudinal direction of the second mounting channel is orthogonal to a plane spanned by the plugging direction and the following direction.

* * * * *